US005216205A

United States Patent [19]

Fujii et al.

[11] Patent Number: 5,216,205

[45] Date of Patent: Jun. 1, 1993

[54] WIRE CONDUCTOR FOR HARNESS

[75] Inventors: Atsuhiko Fujii; Kazuo Sawada; Naoyuki Ohkubo, all of Osaka; Kazunori Tsuji, Mie, all of Japan

[73] Assignee: Sumitomo Electric Industries, Ltd., Mie, Japan

[21] Appl. No.: 766,176

[22] Filed: Sep. 27, 1991

[30] Foreign Application Priority Data

Sep. 28, 1990 [JP] Japan ..... 2-260712

[51] Int. Cl.[5] ..... H01B 5/10; H01B 5/12

[52] U.S. Cl. ..... 174/128.1; 156/50; 174/113 C; 174/126.1; 174/131 A

[58] Field of Search ..... 174/128.1, 128.2, 126.1, 174/126.2, 131 R, 131 A, 113 C; 156/47, 50

[56] References Cited

U.S. PATENT DOCUMENTS

| | | | |
|---|---|---|---|
| 1,751,386 | 3/1930 | Belden | 174/700 |
| 1,943,087 | 1/1934 | Potter et al. | 174/128.1 |
| 3,234.722 | 2/1966 | Gilmore | 174/128.1 |
| 3,717,720 | 2/1973 | Snellman | 174/131 A |
| 4,097,686 | 6/1978 | Gladenbeck et al. | 174/131 A |
| 4,514,589 | 4/1985 | Aldinger et al. | 174/126.2 X |
| 4,820,012 | 4/1989 | Asai | 174/131 A X |
| 4,861,947 | 8/1989 | Altermatt et al. | 174/131 A X |
| 4,936,647 | 6/1990 | Carroll | 174/128.1 X |
| 4,997,992 | 3/1991 | Low | 174/131 A X |

FOREIGN PATENT DOCUMENTS

| | | |
|---|---|---|
| 331182 | 9/1989 | European Pat. Off. . |
| 676325 | 5/1989 | Switzerland . |
| 2023328 | 12/1979 | United Kingdom . |

*Primary Examiner*—Morris H. Nimmo

*Attorney, Agent, or Firm*—Lowe, Price, LeBlanc & Becker

[57] ABSTRACT

Disclosed herein is a wire conductor for a harness, comprising a central portion which is formed of aramid fiber and a conductor portion formed by circularly compressing a stranded wire which is prepared by arranging copper strands around the central portion and braiding the same. The conductor portion has a conductor sectional area of 0.03 to 0.3 $mm^2$.

11 Claims, 1 Drawing Sheet

WIRE CONDUCTOR FOR HARNESS

BACKGROUND OF THE INVENTION

1. Field of the Invention

The present invention relates to a wire conductor for a harness, which is applicable to a wire harness for an automobile, for example.

2. Description of the Background Art

With recent improvement of performance, an automobile is wired in a number of portions such as those of various control circuits, with strong requirement for reliability. On the other hand, a lightweight automobile is increasingly required in view of energy saving etc.

In general, a wire conductor for wiring an automobile is mainly prepared from a stranded wire which is obtained by braiding annealed copper wires defined under JIS C 3102 or those plated with tin. Such a stranded wire is concentrically coated with an insulating material such as vinyl chloride, bridged vinyl or bridged polyethylene, to form a wire.

In automobile wiring circuits, the rate of signal current circuits for control etc., in particular, is increased in recent years. A wire for such circuits is formed by a conductor whose diameter is in excess of an electrically required level for maintaining mechanical strength, in spite of sufficient current carrying capacity.

In order to reduce the weight of such a wire, an attempt has been made to prepare its conductor from aluminum (including alloy).

In general, however, aluminum is so inferior in strength that it is necessary to increase the outer diameter of the conductor or the number of stranded wires, in order to attain sufficient strength. Consequently, the amount of the insulating material is increased to require a large wiring space. Thus, the weight of the wire cannot be sufficiently reduced and the cost for the insulating material is increased.

SUMMARY OF THE INVENTION

An object of the present invention is to provide a wire conductor for a harness whose breaking force is equivalent to that of a conventional harness wire even if its weight is reduced with reduction in diameter, which is hardly broken by an impact and excellent in straightness with no end disjointing of a cut stranded wire.

According to a first mode of the present invention, the wire conductor for a harness comprises a conductor portion having a conductor sectional area of 0.03 to 0.3 $mm^2$, which is obtained by arranging copper strands around a central portion of an aramid fiber bundle or braid for preparing a stranded wire and circularly compressing this stranded wire.

In the first mode of the present invention, the circularly compressed stranded wire is preferably heat treated so that its tensile strength is in a range of 80 to 95% of that before the heat treatment.

Further, such heat treatment is preferably performed in a temperature range of 100 to 150° C. for at least 10 minutes.

According to a second mode of the present invention, the wire conductor for a harness comprises a conductor portion having a conductor sectional area of 0.03 to 0.3 $mm^2$, which is obtained by arranging strands of a copper alloy, containing 0.2 to 2.5 percent by weight of Sn and a rest essentially composed of copper, around a center of an aramid fiber bundle or braid for preparing a stranded wire and circularly compressing this stranded wire.

In the second mode of the present invention, the circularly compressed stranded wire is preferably heat treated so that its tensile strength is in a range of 80 to 95% of that before the heat treatment. Further, such heat treatment is preferably performed in a temperature range of 180 to 350° C. for at least 10 minutes.

According to the present invention, the conductor sectional area is set in the range of 0.03 to 0.3 $mm^2$ since it is difficult to compress a terminal in harness working if the value is less than 0.03 $mm^2$, while the weight of the wire conductor cannot be sufficiently reduced if the value exceeds 0.3 $mm^2$.

According to the present invention, the strands are arranged around the center of an aramid fiber bundle or braid to prepare a stranded wire, in order to obtain a wire conductor which has high tensile strength and impact resistance as well as high conductivity by composing the aramid fiber bundle or braid having extremely high tensile strength and impact resistance with the strands having high conductivity.

The inventive wire conductor for a harness is formed not by a solid wire but by a stranded wire, in order to attain improvement in reliability against repeated bending.

According to the second mode of the present invention, the copper alloy forming the strands which are arranged around the center of the aramid fiber bundle or braid contains 0.2 to 2.5 percent by weight of Sn since the effect of improving the breaking force is reduced if the Sn content is less than 0.2 percent by weight, while the conductivity drops below 40 % if the Sn content exceeds 2.5 percent by weight, to bring the wire into an unpreferable state depending on the circuit.

According to the present invention, the stranded wire is so circularly compressed as to obtain a wire conductor for a harness which has higher breaking force than a conventional harness wire as well as excellent straightness and small disjointing. Thus, the weight of the inventive conductor for a harness can be reduced as compared with the conventional harness wire.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
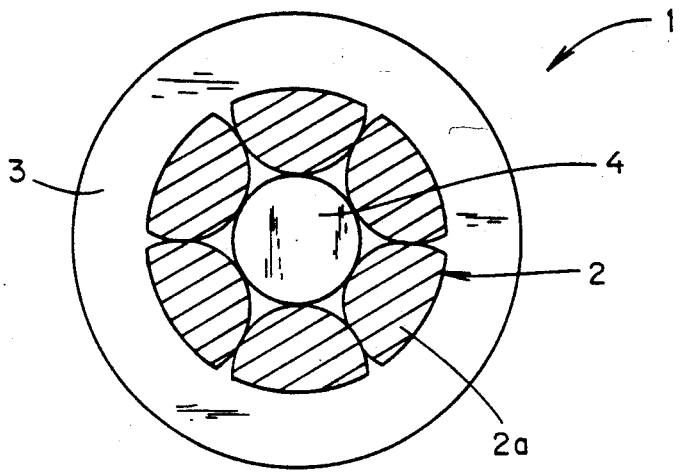
FIG. 1 is a sectional view showing an embodiment of the present invention.

Referring to FIG. 1, a harness wire 1 according to the present invention comprises a stranded wire 2, which is formed by arranging strands **2*a* around an aramid fiber bundle or braid 4 and so compressed as to define a substantially circular configuration as a whole. An insulating coat 3 is provided along the outer periphery of the circularly compressed stranded wire 2**.

Figure 2:
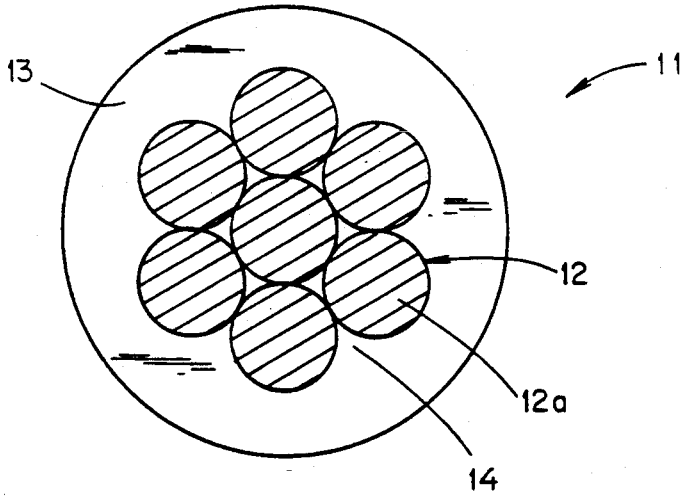
FIG. 2 is a sectional view showing a conventional harness wire.

Referring to FIG. 2, a conventional harness wire 11 comprises a stranded wire 12, which is formed by simply braiding strands **12*a*, and an insulating coat 13 provided around the stranded wire 12. The insulating coat 13 also fills up clearances 14 between the strands 12*a***.

However, such clearances 14 may not be filled up with the insulating coat 13, since these portions are not concerned with insulability. Due to such excessive portions filling up the clearances 14, the amount of the material for the insulating coat 13 is increased and the weight of the wire 11 cannot be sufficiently reduced in various points.

On the other hand, less clearances are defined between the strands *2a* of the inventive harness wire 1 shown in FIG. 1, whereby the amount of the material for the insulating coat 3 can be reduced to reduce the weight of the harness wire 1.

In view of the same sectional area, the outer diameter of the inventive harness wire 1 can be reduced due to the small clearances.

In addition, end disjointing can be suppressed by circularly compressing the stranded wire 2 according to the present invention. Besides, the wire 1 can be improved in straightness by such circular compression.

It has been found that impact resistance is also improved by such circular compression.

In the preferred embodiment of the present invention, the circularly compressed stranded wire is heat treated so that its tensile strength is in a range of 80 to 95% of that before the heat treatment. Impact resistance can be further improved and disjointing of the stranded wire can be further suppressed by such heat treatment. While breaking force in tensile strength is lowered by this heat treatment, it is preferable to control the lowered breaking force in a range of 80 to 95% of that before the heat treatment. If the breaking force after the heat treatment is larger than 95% of that before the heat treatment, disjointing or wire deformation may be caused due to insufficient improvement of an impact value. If the tensile strength drops below 80% of that before the heat treatment, on the other hand, the breaking force is extremely lowered.

In the first mode of the present invention, the heat treatment is preferably performed in a temperature range of 100 to 150° C. If the temperature is less than 100° C, the effect of improving the impact value may not be sufficiently attained, while the breaking force may be significantly lowered if the temperature exceeds 150° C.

In the second mode of the present invention, the heat treatment is preferably performed in a temperature range of 180 to 350° C. If the temperature is less than 180° C., the effect of improving the impact value may not be sufficiently attained, while the breaking force may be significantly lowered if the temperature exceeds 350° C.

In each of the first and second modes of the present invention, the heat treatment time is preferably in excess of 10 minutes. If the heat treatment time is less than 10 minutes, the effect of improving the impact value may not be sufficiently attained.

Example according to the first mode of the present invention is now described.

In each of samples shown in Table 1, six copper strands were arranged around an aramid fiber bundle which was prepared from Kevlar fiber (trade name by Du Pont Co., Ltd.) of aromatic polyamide. Each aramid fiber bundle was prepared by tying up, Kevlar fiber members of 12 μm in diameter, to be equivalent in diameter to each copper strand.

As to the compressed samples shown in Table 1, the stranded wires were passed through holes of dies, to be circularly compressed. Except for those shown with no heat treatment conditions, further, the compressed stranded wires were heat treated under heat treatment conditions shown in Table 1. As to the conventional sample No. 4, generally used annealed copper wires alone were braided to form a stranded wire.

Table 1 also shows conductivity values (IACS, %), breaking force retention rates (%) around heat treatment, breaking force values (kgf), impact values (kg.m), weight values (g/m), and states of wire straightness and end disjointing, which were measured or evaluated as to the stranded wires.

As clearly understood from Table 1, the inventive samples Nos. 1 to 3 were higher in breaking force than the conventional sample No. 4, while the same were lightened with weight values of about 20 to 65 %. The comparative samples Nos. 5 and 6, which were not circularly compressed, were inferior in wire straightness, and caused end disjointing.

All of the inventive samples Nos. 1 to 3 shown in Table 1 were heat treated after circular compression. Table 2 shows additional samples Nos. 7 to 11, which were prepared for the purpose of studying influence of such heat treatment as well as heat treatment conditions. Table 2 again shows the data of the inventive sample No. 1, in order to facilitate comparison.

TABLE 1

| | No. | Strand Diameter (mm) | Compression | Heat Treatment Condition | Conductivity (%) | Breaking Force Retention Rate (%) | Breaking Force (kgf) | Impact Value (kg m) | Weight | Wire Straightness | End Disjointing |
|---|---|---|---|---|---|---|---|---|---|---|---|
| Inventive Sample | 1 | 0.18 | Yes | 120° C. × 2H | 86 | 90 | 12.6 | 0.6 | 1.56 | Excellent | None |
| | 2 | 0.23 | Yes | 120° C. × 2H | 86 | 90 | 20.6 | 0.7 | 2.56 | Excellent | None |
| | 3 | 0.15 | Yes | 120° C. × 2H | 86 | 90 | 8.8 | 0.5 | 1.09 | Excellent | None |
| Conventional Sample | 4 | 0.25 | No | None | 100 | 100 | 7.0 | 0.4 | 3.1 | Excellent | None |
| Comparative Sample | 5 | 0.18 | No | None | 86 | 100 | 14.0 | 0.3 | 1.56 | Inferior | Disjointed |
| | 6 | 0.18 | No | 120° C. × 2H | 86 | 90 | 12.6 | 0.4 | 1.56 | Rather Inferior | Rather Disjointed |

TABLE 2

| No. | Strand Diameter (mm) | Compression | Heat Treatment Condition | Conductivity (%) | Breaking Force Retention Rate (%) | Breaking Force (kgf) | Impact Value (kg m) | Weight (g/m) | Wire Straightness | End Disjointing |
|---|---|---|---|---|---|---|---|---|---|---|
| 1 | 0.18 | Yes | 120° C. × 2H | 86 | 0 | 12.6 | 0.6 | 1.56 | Excellent | None |
| 7 | 0.18 | Yes | 145° C. × 10 min. | 86 | 82 | 11.5 | 0.5 | 1.56 | Excellent | None |

TABLE 2-continued

| No. | Strand Diameter (mm) | Compression | Heat Treatment Condition | Conductivity (%) | Breaking Force Retention Rate (%) | Breaking Force (kgf) | Impact Value (kg m) | Weight (g/m) | Wire Straightness | End Disjointing |
|---|---|---|---|---|---|---|---|---|---|---|
| 8 | 0.18 | Yes | 105° C. × 2H | 86 | 94 | 13.1 | 0.5 | 1.56 | Excellent | None |
| 9 | 0.18 | Yes | None | 86 | 100 | 14.0 | 0.2 | 1.56 | Inferior | Disjointed |
| 10 | 0.18 | Yes | 180° C. × 2H | 86 | 50 | 7.0 | 0.3 | 1.56 | Excellent | None |
| 11 | 0.17 | Yes | 80° C. × 2H | 86 | 98 | 13.7 | 0.2 | 1.56 | Rather Inferior | Rather Disjointed |

Comparing the heat treated sample No. 1 with the sample No. 9 which was not heat treated, it is understood that the impact value is improved and wire deformation and end disjointing are suppressed by performing heat treatment after circular compression, although the breaking force is slightly reduced.

In the sample No. 10 which was heat treated at 180° C, i.e., a temperature higher than 150° C, the breaking force retention rate was 50%. Namely, the breaking force was reduced similarly to the conventional sample No. 4. In the sample No. 11 which was heat treated at 180° C, i.e., a temperature lower than 100° C, the impact value was not much improved.

As understood from the above results, it is preferable to perform heat treatment after compression so that the tensile strength is in a range of 80 to 95% of that before the heat treatment. Further, such heat treatment is preferably performed at a temperature of 100 to 150° C. for at least 10 minutes.

Example according to the second mode of the present invention is now described.

In each sample, six alloy strands having the Sn content shown in Table 3 were arranged around an aramid fiber bundle prepared from Kevler fiber (trade name by Du Pont Co., Ltd.]of aromatic polyamide. Each aramid fiber bundle was prepared by tying up Kevlar fiber members of 12 μm in diameter, to be equivalent in diameter to each copper strand.

As to the compressed samples shown in Table 3, the stranded wires were passed through holes of dies, to be circularly compressed. Except for those shown with no heat treatment conditions, further, the compressed stranded wires were heat treated under heat treatment conditions shown in Table 3. As to the conventional sample No. 31, generally used annealed copper wires were braided to form a stranded wire.

Table 3 also shows conductivity values (IACS, %), breaking force retention rates (%) around heat treatment, breaking force values (kgf), impact values (kg.m), weight values (g/m), and states of wire straightness and end disjointing, which were measured or evaluated as to the stranded wires.

TABLE 3

| | No. | Sn Content (wt. %) | Strand Diameter (mm) | Compression | Heat Treatment Condition | Conductivity (%) | Breaking Force Retention Rate (%) | Breaking Force (kgf) | Impact Value (kg m) | Weight (g/m) | Wire Straightness | End Disjointing |
|---|---|---|---|---|---|---|---|---|---|---|---|---|
| Inventive Sample | 21 | 0.5 | 0.18 | Yes | 220° C. × 2H | 54 | 93 | 17.5 | 0.5 | 1.4 | Excellent | None |
| | 22 | 1.8 | 0.18 | Yes | 250° C. × 2H | 33 | 92 | 18.5 | 0.6 | 1.4 | Excellent | None |
| | 23 | 1.5 | 0.18 | Yes | 250° C. × 2H | 36 | 91 | 18.1 | 0.5 | 1.4 | Excellent | None |
| | 24 | 0.3 | 0.18 | Yes | 250° C. × 2H | 69 | 84 | 16.6 | 0.5 | 1.4 | Excellent | None |
| | 25 | 2.1 | 0.18 | Yes | 250° C. × 2H | 30 | 94 | 18.8 | 0.6 | 1.4 | Excellent | None |
| | 26 | 0.9 | 0.18 | Yes | 250° C. × 2H | 43 | 87 | 17.3 | 0.5 | 1.4 | Excellent | None |
| | 27 | 2.4 | 0.18 | Yes | 250° C. × 2H | 27 | 95 | 20.1 | 0.8 | 1.4 | Excellent | None |
| | 28 | 0.3 | 0.23 | Yes | 250° C. × 2H | 69 | 84 | 19.0 | 0.6 | 2.4 | Excellent | None |
| | 29 | 2.4 | 0.13 | Yew | 250° C. × 2H | 27 | 75 | 14.9 | 0.4 | 0.7 | Excellent | None |
| | 30 | 1.2 | 0.18 | Yes | 250° C. × 8 min. | 39 | 99 | 17.7 | 0.4 | 1.4 | Excellent | None |
| Conventional Sample | 31 | 0 | 0.25 | No | None | 100 | 98 | 7.0 | 0.4 | 3.1 | Excellent | None |
| Comparative Sample | 32 | 0 | 0.18 | Yes | 250° C. × 2H | 86 | 47 | 10.8 | 0.4 | 1.4 | Excellent | None |
| | 33 | 0.1 | 0.18 | Yes | 250° C. × 2H | 80 | 88 | 11.5 | 0.4 | 1.4 | Excellent | None |
| | 34 | 2.7 | 0.18 | Yes | 250° C. × 2H | 20 | 98 | 19.9 | 0.4 | 1.4 | Excellent | None |
| | 35 | 0.5 | 0.18 | No | None | 54 | 99 | 20.9 | 0.1 | 1.4 | Inferior | Disjointed |
| | 36 | 0.3 | 0.16 | No | 250° C. × 2H | 69 | 86 | 16.2 | 0.2 | 1.2 | Rather Inferior | Rather Disjointed |

As clearly understood from Table 3, the inventive samples Nos. 21 to 30 were higher in breaking force than the conventional sample No. 31, while the same were lightened with weight values of about ⅓ to ¾. The comparative samples Nos. 32 and 33, containing smaller amounts of Sn, exhibited no high breaking force values dissimilarly to the inventive samples. In the comparative sample No. 34 containing a larger amount of Sn, the conductivity values was significantly reduced although high breaking force was attained. Further, the comparative samples Nos. 35 and 36, which were not circularly compressed, were inferior in wire straightness, and caused end disjointing.

All of the inventive samples Nos. 21 to 30 shown in Table 3 were heat treated after circular compression. Table 4 shows additional samples Nos. 37 to 39, which were prepared from the purpose of studying influence of such heat treatment as well as heat treatment conditions. Table 4 again shows the data of the sample No. 21, in order to facilitate comparison.

TABLE 4

| No. | Sn Content (wt. %) | Strand Diameter | Compression | Heat Treatment Condition | Conductivity (%) | Breaking Force Retention Rate (%) | Breaking Force (kgf) | Impact Value (kg m) | Weight (g/m) | Wire Straightness | End Disjointing |
|---|---|---|---|---|---|---|---|---|---|---|---|
| 21 | 0.5 | 0.18 | Yes | 220° C. × 2H | 54 | 92 | 17.5 | 0.5 | 1.4 | Excellent | None |
| 37 | 0.5 | 0.18 | Yes | None | 52 | 98 | 18.4 | 0.1 | 1.4 | Rather Inferior | rather disjointed |
| 38 | 0.5 | 0.18 | Yes | 400° C. × 2H | 54 | 50 | 12.4 | 0.4 | 1.4 | Excellent | None |
| 39 | 0.5 | 0.18 | Yes | 150° C. × 2H | 54 | 97 | 18.3 | 0.2 | 1.4 | Rather Inferior | rather disjointed |

Comparing the heat treated sample No. 21 with the sample No. 37 which was not heat treated, it is understood that the impact value is improved and wire deformation and end disjointing are suppressed by performing heat treatment after circular compression, although the breaking force is slightly reduced.

In the sample No. 38 which was heat treated at 400° C., i.e., a temperature higher than 350° C., the breaking force retention rate was 50% and the breaking force dropped to about that of the conventional sample No. 31. In the sample No. 39 which was heat treated at 150° C., i.e., a temperature lower than 180° C, the impact value was not much improved.

As clearly understood from the above results, it is preferable to perform heat treatment after compression so that the tensile strength is in a range of 80 to 95% of that before the heat treatment. Further, it is preferable to perform heat treatment in a temperature range of 180 to 350° C. for at least 10 minutes.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A wire conductor for a harness comprising:

a central portion formed of aramid fiber; and a conductor portion of circularly compressed stranded wire including copper strands positioned and braided around said central portion, said conductor portion having a conductor section area of 0.03 to 0.3 $mm^2$ and being heat treated so that a tensile strength thereof is in a range of 80 to 90% of that before heat treatment.

2. A wire conductor for a harness in accordance with claim 1, wherein said heat treatment is performed at a temperature of 100 to 150° C. for at least 10 minutes.

3. A wire conductor for a harness comprising:

a central portion formed of aramid fiber; and a conductor portion of circularly compressed stranded wire including strands of a copper alloy, containing 0.2 to 2.5 percent by weight of Sn and a remainder essentially composed of copper, said strands positioned and braided around said central portion, said conductor portion having a conductor sectional area of 0.03 to 0.3 $mm^2$.

4. A wire conductor for a harness in accordance with claim 3, wherein said conductor portion is heat treated so that its tensile strength is in a range of 80 to 95% of that before heat treatment.

5. A wire conductor for a harness in accordance with claim 4, wherein said heat treatment is performed at a temperature of 180 to 350° C. for at least 10 minutes.

6. A wire conductor comprising:

a central portion formed of aramid fiber; and a heat treated conductor portion of circularly compressed stranded wire including copper strands positioned and braided around said central portion.

7. A wire conductor according to claim 6 wherein said conductor portion has a conductor sectional area of 0.03 to 0.3 $mm_2$.

8. A method of forming a wire conductor comprising the steps of:

forming a central portion of aramid fiber;

braiding a plurality of copper strands about said central portion;

circularly compressing the braided copper strands on said central portion; and heat treating the circularly compressed stranded wire at a temperature within a range of 100 to 350 degrees Celsius.

9. The method of claim 8 wherein said heat treating step is performed at a temperature within a range of 100 to 350 degrees Celsius.

10. The method of claim 8 wherein said heat treating step is performed at a temperature of 180 to 350 degree Celsius for at least 10 minutes.

11. The method of claim 8 wherein said heat treating step is performed at a temperature of 100 to 150 degrees Celsius.

* * * * *